United States Patent [19]

Sullivan et al.

[11] 4,449,553

[45] May 22, 1984

[54] ELECTRICALLY HEATED PIPE THAWING APPARATUS

[76] Inventors: Edward F. Sullivan, 18450 Thorpe Rd., Wayzata, Minn. 55391; Patrick Sullivan, 18645 Rutledge Rd., Wayzata, Minn. 55391; Walter C. Schultz, 4390 Coolidge Ave., Edina, Minn. 55424

[21] Appl. No.: 209,976

[22] Filed: Nov. 24, 1980

[51] Int. Cl.[3] ..... E03B 7/14; F24H 1/20

[52] U.S. Cl. ..... 138/35; 219/296; 219/310; 219/312

[58] Field of Search ..... 219/296, 310, 312, 306, 219/297; 138/33–35

[56] References Cited

U.S. PATENT DOCUMENTS

| | | | |
|---|---|---|---|
| 458,503 | 8/1891 | Simpson | 138/35 |
| 501,744 | 7/1893 | Streeper | 138/35 |
| 1,243,973 | 10/1917 | Philippon | 138/35 |
| 1,361,023 | 12/1920 | Darley | 138/35 |
| 4,102,358 | 7/1978 | Sherock | 138/35 |
| 4,124,039 | 11/1978 | St. Laurent | 138/35 |
| 4,250,925 | 2/1981 | Mast | 138/35 |

*Primary Examiner*—A. Bartis

*Attorney, Agent, or Firm*—Hugh D. Jaeger

[57] ABSTRACT

Apparatus for thawing a pipe having a frozen blockage therein, the apparatus including a self-contained unit on wheels, the unit including a tank for holding water, an electric immersion heater in the tank for heating the water to a temperature of 100°–150° F., a pump supported on the unit, a foot switch connected to the pump, a pressure control connected to the pump, a reel of flexilbe polyurethane hose and a reel of return hose mounted on respective sides of the tank, and a conical coupling for connecting to one end of the frozen pipe, the coupling including a compression fitting for engaging around the flexible hose, and a T-shaped return fitting for connecting to the return hose. The flexible hose is pushed through the compression fitting towards the frozen blockage and emits a stream of water under pressure from the pump that erodes and eliminates the frozen blockage, and return water is pushed from the blockage back to the return fitting and through the return hose to the container thereby providing a closed loop system. A pressure relief and bypass valve connects the outlet side of the pump to the container through a bypass line. The system operates on ordinary house current. The closed loop system provides for no fluid leakage between the pipe, hoses and the container.

1 Claim, 6 Drawing Figures

ELECTRICALLY HEATED PIPE THAWING APPARATUS

BACKGROUND OF THE INVENTION

1. Field of the Invention

The present invention relates to a pipe thawer, and more particulary, pertains to a self-contained portable pipe thawer for use on any type of pipe.

2. Description of the Prior Art

Prior art apparatus and methods for thawing pipes have existed since the advent of the pipe. Where pipe was accessible, fires, torches, and electrical resistance cables were used to eliminate frozen blockages. Where pipe was not accessible, welding cables were hooked to each end of the pipe, and large amounts of current were passed through the pipe, hopefully generating enough heat thereby thawing and eliminating the frozen blockage, although this is not always possible.

Since the advent of plastic pipe, such prior art apparatus or methods are not at all operable for eliminating frozen blockages. While one prior art device flows a liquid down the pipe towards the frozen blockage, the system does not provide a closed loop or elevated temperature, and is less than desirable from protecting the adjacent area against water damage or from preventing the individual from getting wet during operation.

The present invention overcomes the disadvantages of the prior art by providing a pipe thawing system having a closed loop system for thawing fluid, and is a self contained portable unit.

SUMMARY OF THE INVENTION

The general purpose of the present invention is a pipe thawer providing a system in a self contained portable unit, operable on ordinary house current, which couples to any type of pipe, and which can be utilized by a single operator. The system eliminates any spilling or discharge of liquid, and is safe and sanitary.

According to one embodiment of the present invention, there is provided a pipe thawer system including one water-tight container on wheels, an immersion heater in the tank, a regulated pump connected to the container, a foot switch connected to the pump motor, a length of flexible tube connected between a compression coupling which connects to a pipe having a frozen blockage therein and the pump and a length of return hose connected between the compression coupling and the pipe and the container, whereby the pump ejects fluid through the flexible hose at an elevated temperature at the frozen blockage and the return hose returns water to the container for recycling in a closed loop system.

A significant aspect and feature of the present invention is a self contained system in combination for connection to one end of a pipe having a frozen blockage therein. A threaded member fastens onto one end of a pipe, and includes a compression fitting for securing about an elongated reeled flexible hose and a return fitting for connection to a return hose. The other ends of the hoses connect to a container forming a closed loop fluid system.

Another significant aspect and feature of the present invention is a foot operated switch for controlling the fluid flow during eroding of the frozen blockage, and temperature and pressure controls for the temperature of the water in the container and pressure provided by the speed of the pump motor or by a pressure regulator.

A further significant aspect and feature of the present invention is a closed loop system protecting the operator and surrounding environment from spilled fluid or liquid.

Having described one embodiment of the present invention, it is a principal object hereof to provide an apparatus and process for thawing a pipe having a frozen blockage therein, whether the pipe be plastic or metal.

An object of the present invention is to provide a self-contained closed loop pipe thawing system for eliminating a frozen blockage in a pipe, whether the pipe be a water line into a building or a water main in the street. The system operates on any type of blockage at any distance from the point of access of the pipe.

Another object of the present invention is a pipe thawer system which can be easily operated by one individual, and requires minimal tools such as a pipe wrench or pliers to temporarily hook up to a pipe for operation.

BRIEF DESCRIPTION OF THE DRAWINGS

Other objects and many of the attendant advantages of this invention will be readily appreciated as the same becomes better understood, by reference to the following detailed description when considered in connection with the accompanying drawings, in which like reference numerals designate like parts throughout the figures thereof and wherein.

DESCRIPTION OF THE EMBODIMENTS

Figure 1:
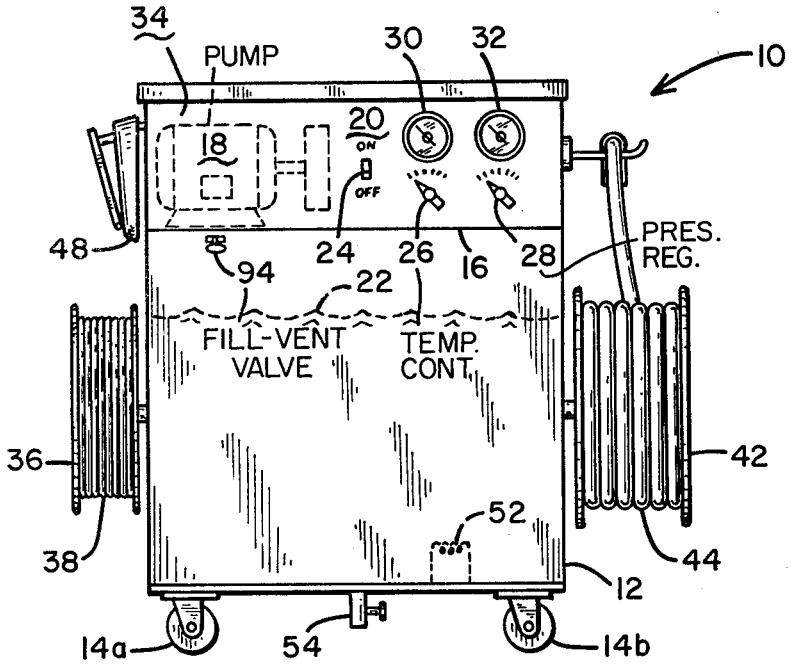
FIG. 1 illustrates a plan view of a pipe thawer system, the present invention.
Figures 2, 4, 5:
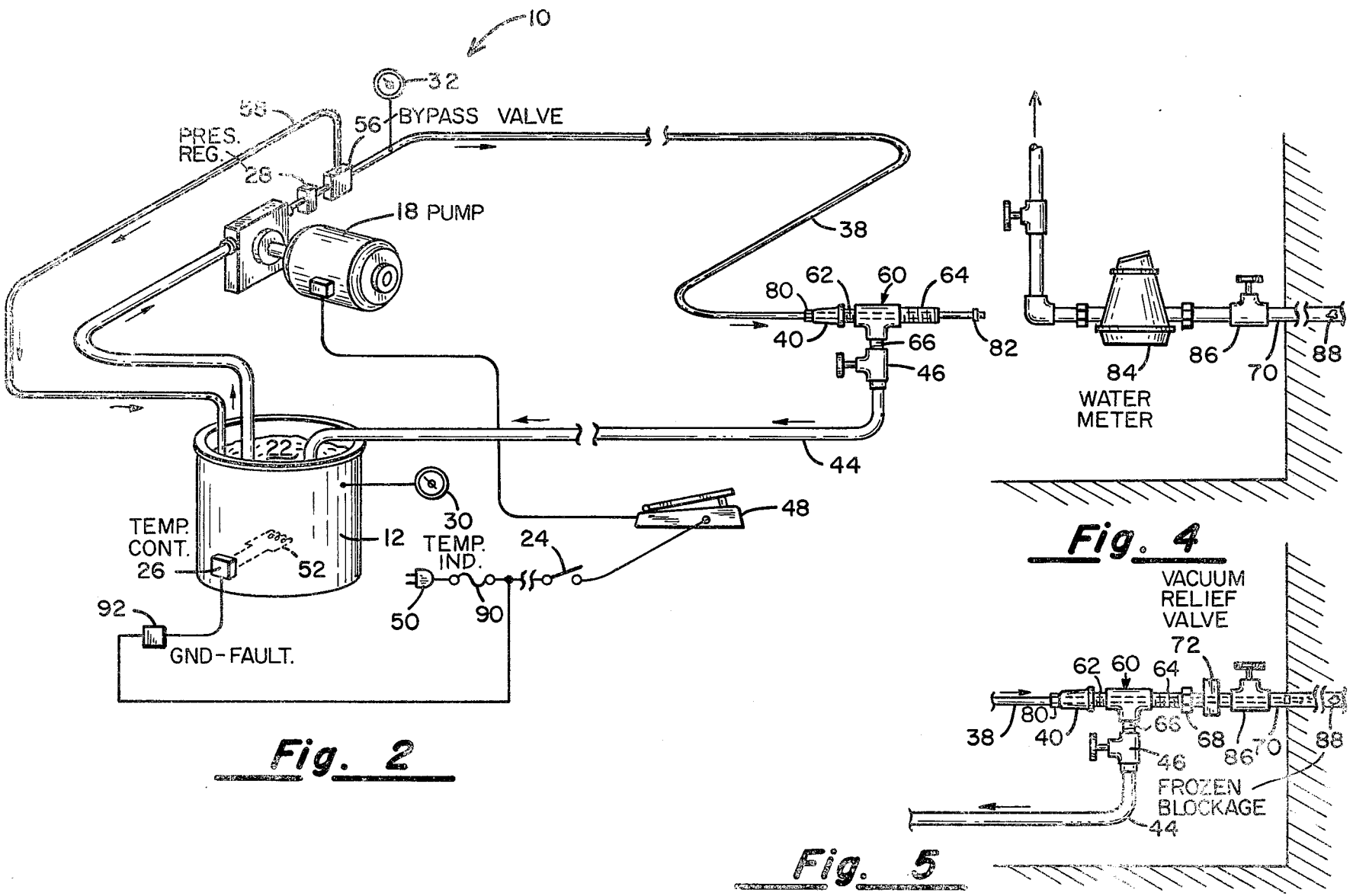
FIG. 2 illustrates a schematic diagram of the components of the system.
FIG. 4 illustrates a typical water line water meter installation.
FIG. 5 illustrates the compression coupling and associated components connected to the water line.

FIG. 1 which illustrates a plan view of a pipe thawer system 10 of the present invention, shows a rectangular container 12 mounted on four wheels, two wheels **14*a* and 14*b* being illustrated. A separating plate 16 positions adjacent the top of the container 12, and supports and isolates a pump 18 in a compartment 20 from a water supply 22. An on-off switch 24, a temperature controller 26, and a pressure regulator 28, a temperature dial 30, and a pressure dial 32 positioned on a front panel 34. A reel 36 of flexible hose 38 including a compression coupling 40 in FIG. 2 and a reel 42 of return hose 44 including a return valve 46 in FIG. 2 are axially supported on opposing sides of the container 12. A foot switch 48 connects between a power source 50 of FIG. 2 and the pump 18. An immersion high recovery electrical resistance heater 52 is positioned in the container 12 for heating the water or like fluid 22 to a predetermined elevated temperature. A drain outlet 54** is provided in the bottom of the container.

FIG. 2, which illustrates a fluid schematic diagram of the pipe thawing system 10, shows the layout and schematic connections of the parts of the system and where the numerals correspond to those elements previously described. Additionally, a pressure relief and bypass valve 56 connects on the outlet side of the pump 18 and includes a bypass line 58 connected between the valve 56 and the container 12. A T connection 60 including sections 62, 64, and 66 and a coupling nut 68 illustrated in FIG. 5 connects the compression coupling 40 and the return coupling 46 to one end of a pipe 70 having a frozen blockage 88, also illus. in FIG. 5. A vacuum relief valve 72 can connect between the section 64 and the pipe 70 if required by code, as illustrated in FIG. 5.

Figure 3:
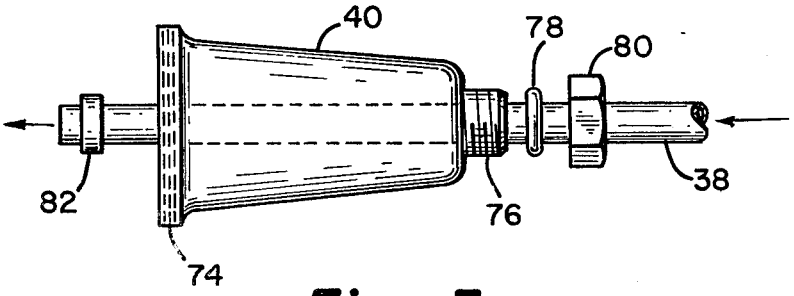
FIG. 3 illustrates a plan view of a compression coupling.

FIG. 3, which illustrates a plan view of the compression coupling 40 and the flexible hose 38 inserted therethrough, includes an interior threaded end 74, an exterior threaded end 76 of reduced diameter, an expansion rubber washer 78, and a nut 80. The rubber washer 78 expands about the flexible hose 38 for prohibiting water or liquid flowing out of the coupling 40. Tape 82 or similar material wrapped about the end of the hose prevents back pressure of the water pushing the hose 38 out of the coupling 42.

MODE OF OPERATION

FIG. 4 illustrates a plan view of a conventional water system including pipe 70 having a frozen blockage 88 therein. The pipe 70 is shown in broken lines and the frozen blockage 88 can be a few feet to a few hundred feet away from a point of access such as a water meter 84. An alternative entrance for the apparatus can be at any other suitable point, such as the street, etc., and FIG. 4 is by way of example and illustration only, and is not to be construed as limiting of the present invention. For obtaining access to the frozen blockage 88, the inlet side of the water meter 84 is removed at the outlet side of the main shut off valve 86 of the water line.

FIG. 5 illustrates the flexible hose 38 pipe thawer system 10 installed at the outlet side of the main shut off valve 86 where the compression coupling 40 connects through T connection 60 to the valve 86 and the return coupling valve 46 connects to section 66 of T connection 60.

In operation, the foot switch controls the modulated pumping of water under pressure at 2–1000 p.s.i. at an elevated temperature of 100°–150° Fahrenheit, preferably 140° through flexible hose 38 gradually eroding and eliminating the frozen blockage 88 in the pipe. During the eroding process, the flexible hose 38, in the range of one-quarter inch or larger outer diameter for residential use, is continually pushed towards the blockage with a constant stream of water or fluid emitted by the hose 38, with the return water flowing from the pipe 70, and out through members 64 and 66 of T connection 60, and the return valve 46 back to the container 12, thereby providing for a closed loop fluid system with no water lost on the operator or surrounding environment. The heater 52 controlled by controller 26 heats the water to the desired elevated temperature, although such is not required as room temperature water will also work, and the pressure regulator 28 controls the discharge pressure which erodes and subsequently eliminates the frozen blockage in the pipe 70. During the pushing of the flexible hose 38 towards the blockage, the foot switch 48 controls operation of the pump 18 and subsequent flow of the water or fluid at an elevated temperature towards the frozen blockage.

Once the frozen blockage 88 is eliminated, the operator will hear the flow of water and the water pressure will push the hose 38 backwards out of the compression fitting 40 until the tape 82 engages the inside diameter of the fitting 40 preventing disengagement of the two members 38 and 40 and providing for integrity of the closed loop system. The return valve 46 can be turned off, eliminating the flow of water through the pipe 70 prior to the closing of the water valve 46.

ALTERNATIVE EMBODIMENT

Figure 6:
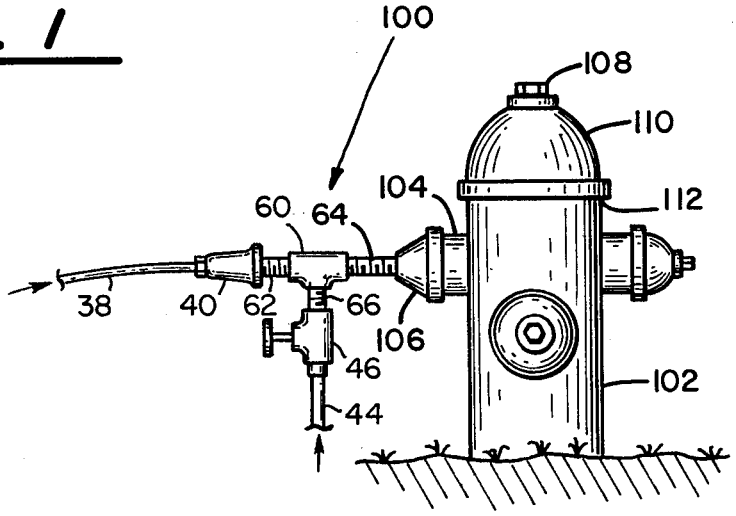
FIG. 6 illustrates an alternative embodiment of the present invention.

FIG. 6, which illustrates an alternative embodiment of a pipe thawer system 100 of the present invention connected to a hose fitting of a fire hydrant 102 for use in thawing of a water main pipe. A reducer 106 connects section 64 of T connection 60 to the hose outlet connection 104. The flexible hose is pushed and snaked into the water main under the ground for eroding and eliminating the frozen blockage. In an additional embodiment, the operating nut 108, and hydrant stem and bonnet 110 can be removed and the pipe thawer system 100 can be appropriately coupled to the base 112 of hydrant 102 for feed through into a water main.

Various modifications can be made to the present invention without departing from the apparent scope thereof. The size of the flexible hose and return hose can be varied as being dependent upon the size of pipe being blocked and the size blockage being eliminated. The size of the container, pump, and heater can be also varied according to the conditions at hand without departing from the scope of the present invention.

The system 10 can also include the pressure regulator 28 located in line on the outlet of the pump in lieu of being installed on the pump. A circuit breaker 90 and ground fault indicator 92 can be located at a suitable position in the pump and heater electrical line. The water can also be heated externally by a suitable device and the container can have a capacity of 2–2000 gallons, the larger capacity for water main thawing. A water-fill-vent valve 94 can be provided in the top of the container 12 for filling the container, providing chlorine, either liquid or tablets, into the container if required by code for water purification and discharging overflow water into a drain via a hose in the event of unusually high backpressures in the system. Elements 40, 46, and 60–66 constitute the charge-return unit. The pump 18 can also be a variable speed pump.

Having thus described the invention, what is claimed is:

1. In combination, pipe thawer system for thawing a pipe having a frozen blockage therein, said system comprising:

a. means for securing onto one end of a pipe having a frozen blockage therein, said securing means including a means forming a compression seal about a small diameter, quarter-inch outer diameter polyurethane flexible hose, said securing means including conical shaped pipe reducer including an inflow and an outflow end, a hole in said inflow end through which said flexible hose slidably extends, a threaded circumference about said inflow end, and a nut with a compression washer threaded over said circumference for engaging and securing about said hose to form said compression seal;

b. wheeled portable means for containing a predetermined quantity of water, said means including a substantially rectangular upstanding container means for supporting said system, four wheels spaced about an underside of said container means for rolling motion, and including a separating plate for isolating fifty-five gallons of liquid in a lower portion of said container, a discharge outlet in the bottom of said container means and a liquid-fill vent valve on one side of said container means slightly below said separating plate;

c. said flexible hose piping water from said container means and through said inflow end of said securing means towards said frozen blockage, said flexible hose supported on a substantially circular reel means on one side of said container means;

d. means for pumping water from said container to said flexible hose, said pumping means supported in a top portion of said container means and including a foot pedal connected to said pump means for actuating said pump means and a pressure regulator means in line with said flexible hose and a bypass line hose means connected between said pressure regulator means and said container means;

e. variable temperature control means including electric heater means immersed in said container means for heating said water to a predetermined temperature of 100°-150° F.;

f. electrical circuit means supported in said container means powering said pump means and said variable temperature control means, said electrical circuit means including circuit breaker means and ground fault indicating means connected between said pump means and said variable temperature control means and a source of power, and said electrical circuit means and pump means supported above said separating plate and isolated from liquid in a lower portion of said container means; and, g. return hose means for piping return water from a T-shaped return means to said container means, said T-shaped return means connected between said outflow end of said pipe reducer and said pipe with said frozen blockage, a leg of said T-shaped return means connected to said return hose means, said return hose means supported on a substantially circular reel means on an other side of said container means whereby said water is piped from said container under pressure by said pump means through said flexible hose towards said frozen blockage, forcing return water from the area of said frozen blockage through said T-shaped return means and said return hose means into said container thereby providing a closed-loop, self-contained pipe thawer system including feedback fluid from said frozen blockage and avoiding liquid spillage.

* * * * *